US005586905A

United States Patent [19]

Marshall et al.

[11] Patent Number: 5,586,905

[45] Date of Patent: Dec. 24, 1996

[54] INSULATION DISPLACEMENT ELECTRICAL CONNECTOR WITH IMPROVED STRAIN RELIEF

[75] Inventors: Robert C. Marshall, St. Petersburg; Frank Pansari, Jr., Clearwater, both of Fla.

[73] Assignee: Molex Incorporated, Lisle, Ill.

[21] Appl. No.: 146,384

[22] Filed: Nov. 1, 1993

[51] Int. Cl.[6] ..... H01R 13/58

[52] U.S. Cl. ..... 439/463; 439/474

[58] Field of Search ..... 439/397, 409, 439/399, 596, 460, 463, 467, 474, 475, 443, 881

[56] References Cited

U.S. PATENT DOCUMENTS

| | | | |
|---|---|---|---|
| 3,936,128 | 2/1976 | D'Annessa et al. | 439/399 |
| 4,277,124 | 7/1981 | Loose et al. | 439/398 |
| 4,444,447 | 4/1984 | Markwardt | 439/392 |
| 4,653,831 | 3/1987 | Wilson et al. | 439/404 |
| 4,842,546 | 6/1989 | Song | 439/409 |
| 4,995,827 | 2/1991 | Rudoy | 439/405 |
| 5,030,136 | 7/1991 | Reinhardt et al. | 439/460 |

FOREIGN PATENT DOCUMENTS

| | | | |
|---|---|---|---|
| 0062963 | 10/1982 | European Pat. Off. | H01R 4/24 |
| 558666 | 9/1932 | Germany | 439/460 |

*Primary Examiner*—P. Austin Bradley
*Assistant Examiner*—Jeanne M. Elpel
*Attorney, Agent, or Firm*—Stacey E. Caldwell

[57] ABSTRACT

An electrical connector assembly is provided for terminating an insulated electrical wire. The assembly includes a housing having a wire-receiving opening adapted to receive the insulated electrical wire. The housing is defined by two housing halves which are relatively movable between an open condition for insertion of an insulated wire into the opening and a closed condition. A terminal is mounted on the housing and has an insulation displacement slot positioned in the opening adapted to displace the insulation of the wire and electrically engage an inner conductor of the wire. Opposing flexible portions of the housing halves provide strain relief to the insulated electrical wire by gripping the wire substantially entirely thereabout when the housing halves are in their closed condition.

9 Claims, 3 Drawing Sheets

INSULATION DISPLACEMENT ELECTRICAL CONNECTOR WITH IMPROVED STRAIN RELIEF

FIELD OF THE INVENTION

This invention generally relates to the art of electrical connectors and, particularly, to a connector which incorporates an insulation displacement terminal means in conjunction with an improved strain relief means.

BACKGROUND OF THE INVENTION

There has been a wide variety of electrical connectors or connector assemblies adapted for insulation-displacement termination of an insulated electrical wire. Such connectors sometimes are called "solderless" connectors. In other words, a typical insulated wire includes a center conductor (which may be solid or stranded) surrounded by an insulating cladding or cover. The connector includes some form of terminal means which pierces through the insulation and establishes direct electrical engagement with the interior conductive core. A typical insulation displacement terminal includes an insulation-piercing slot defined by cutting edges for cutting through the insulation and further defining an electrical contact area for engaging the conductive core of the wire.

The terminals of such insulation displacement connectors most often are fabricated of stamped and formed sheet metal material and typically the forming and "cutting" requirements of the material necessitate that the material be relatively thin. Therefore, it can be understood that the electrical contact area (i.e. the edges of the insulation-piercing slot which contact the conductive core) is relatively small, particular in comparison to a crimped wire connection, for instance. Accordingly, when such an insulation displacement connection is used in applications where it is subject to vibration or shock, the conductive core of the insulated wire is prone to move, bend or deform due to a high level of stress at the contact interface. In fact, continuous bending of the conductive core can result in "work hardening" of the metal conductor which, in turn, causes brittleness and even breakage of the core, and eventual electrical failure. Therefore, in such applications, various forms of strain relief means have been provided for the insulated electrical wire, usually supporting the insulation at a location remote from the electrical contact area or interface.

Among prior attempts to provide strain relief for the electrical wire, one approach is to provide an insulation crimping section on the insulation displacement terminal itself. In other words, one portion (such as a slotted portion) of the terminal pierces the insulation of the wire, and another portion of the terminal is crimped onto the outer insulation of the wire spaced from the insulation-piercing portion. An example of such an approach is shown in U.S. Pat. No. 4,277,124, dated Jul. 7, 1981. One problem associated with such an approach is that a secondary crimping tool must be provided and an additional secondary crimping step must be performed, all of which is costly in terms of time and labor. Other approaches to providing strain relief on the insulated wire include utilizing portions of the housing to support the wire against at least some bending at the contact area or interface. However, most such structures typically are designed to support the wire in only a given direction rather than on all sides of, or circumferentially about, the wire.

The present invention is directed to providing an insulation displacement electrical connector with an improved wire strain relief means which is extremely simple, inexpensive and very effective in providing support for the wire substantially entirely thereabout.

SUMMARY OF THE INVENTION

An object, therefore, of the invention is to provide a new and improved electrical connector assembly for terminating an insulated electrical wire by insulation displacement means along with an improved strain relief means for the wire.

In the exemplary embodiment of the invention, the connector assembly includes a housing having an opening into which the insulated electrical wire is insertable. A terminal is provided within the housing, and has an insulation displacement slot adapted to displace the insulation of the wire and electrically engage a conductor thereof. Specifically, the housing includes a pair of housing halves which are relatively movable between an open condition for insertion of the insulated wire into the opening and a closed position for final termination of the insulated wire and/or where the connector is positively latched. The housing halves are relatively movable and connected by way of an integrally molded hinge.

Generally, the invention contemplates the provision of integrally molded strain relief means operatively associated between the housing halves for surrounding and gripping the insulated wire substantially entirely thereabout when the housing halves are in their closed position. Specifically, the strain relief means are provided by opposing flexible portions of the housing halves.

As disclosed herein, the electrical connector assembly is a form of a "tap" connector in that the insulated electrical wire runs through the connector. Consequently, in the preferred embodiment, the integrally molded strain relief means is provided by opposing or complementary flexible portions of the housing halves on both sides of the insulation displacement slot, generally where the wire exits the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
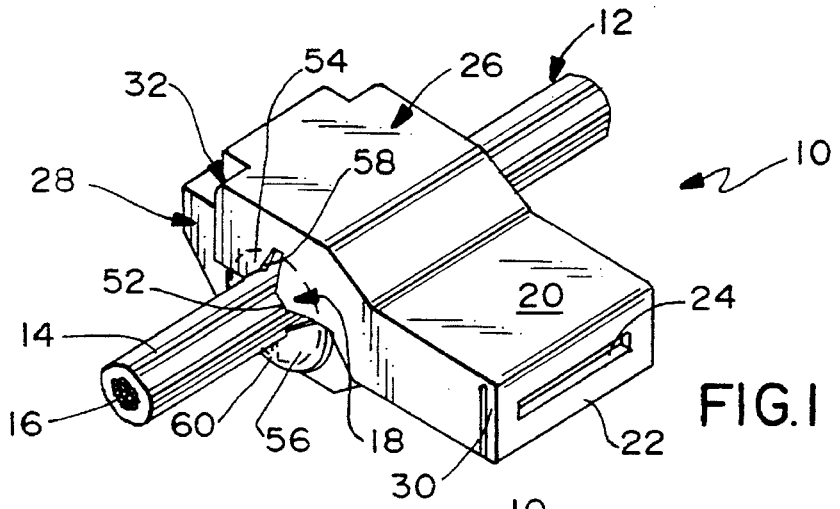
FIG. 1 is a perspective view of an electrical connector assembly embodying the concepts of the invention, the assembly being terminated to an insulated electrical wire.

Referring to the drawings in greater detail, and first to FIG. 1, the invention is embodied in an electrical connector assembly, generally designated 10, for terminating an insulated electrical wire, generally designated 12. It can be seen that the wire runs completely through the connector assembly and, therefore, the connector is what commonly is termed a "tap" connector. As will be described in greater detail hereinafter, the connector is an insulation displacement connector, in that it incorporates a terminal for piercing through the outer insulative cladding or covering 14 of insulated electrical wire 12 for establishing direct electrical connection with the conductive core 16 of the wire without the use of secondary crimping or stopping tools. The core may be a single solid conductor, or it might be a stranded conductive core as shown clearly in FIG. 1. The stranded conductive core includes a plurality of small conductive strands, as shown.

As stated in the "Background" above insulation displacement connectors encounter problems in applications where the electrical connection is subject to vibration or shock which tend to deform, bend or perhaps break the conductive core of the insulated electrical wire. This is particularly true when using a stranded conductive core as at 16. The small strands, such as of copper wire, have a tendency to become work-hardened when subjected to bending, such as may be caused by vibration or other constant movement. This work-hardening causes the strands to become brittle and perhaps to break, and therefore may eventually lead to electrical failure. Consequently, the invention contemplates an improved strain relief means, generally designated 18 in FIG. 1, for gripping insulated wire 12 substantially entirely thereabout when the housing is in its closed or terminated position as shown in FIG. 1.

Before proceeding with the details of the invention, and still referring to FIG. 1, connector 10 includes a housing defining a plug portion 20 for insertion into a complementary receptacle of a mating connector, as described hereinafter. An end wall or mating face 22 of the plug portion includes an elongated slot 24 for receiving a blade contact of the mating connector. Actually, the housing of connector 10 is defined by a pair of dielectric housing halves, generally designated 26 and 28, which are molded of plastic material and joined by a living hinge, as at 30. Lastly, while still referring to FIG. 1, the housing halves have complementary latch means 32 for holding the housing means in a closed condition as shown, with strain relief means 18 gripping insulated wire 12 substantially entirely thereabout.

Figure 2:
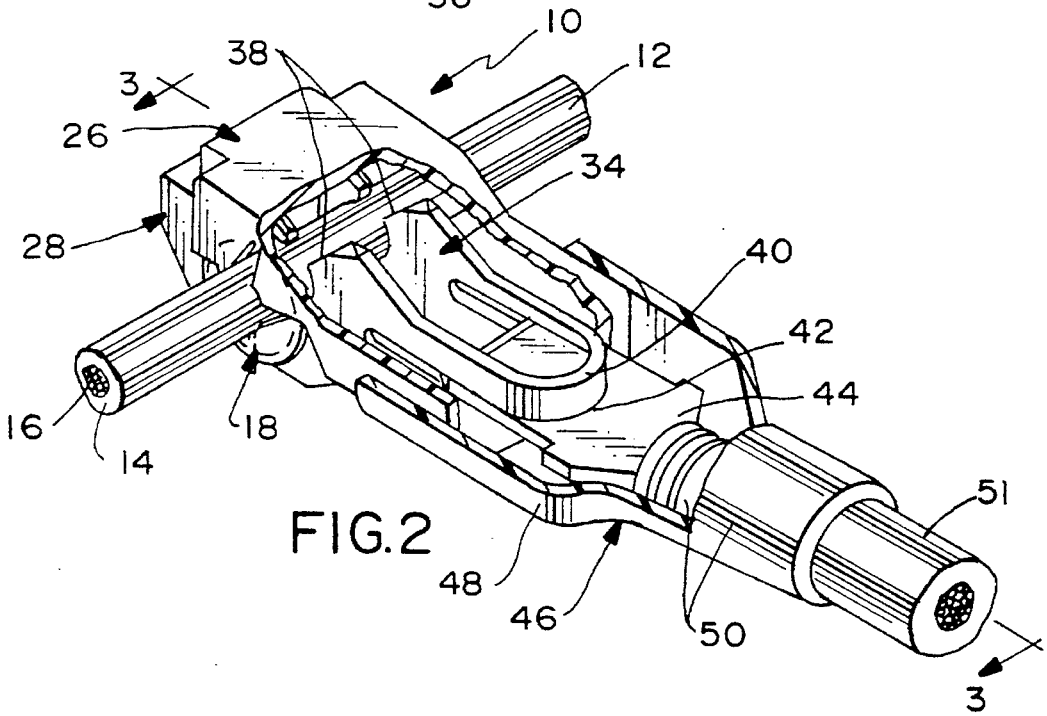
FIG. 2 is a perspective view of a fragmented horizontal section through the connector assembly of FIG. 1, with a complementary connector mated therewith.
Figure 3:
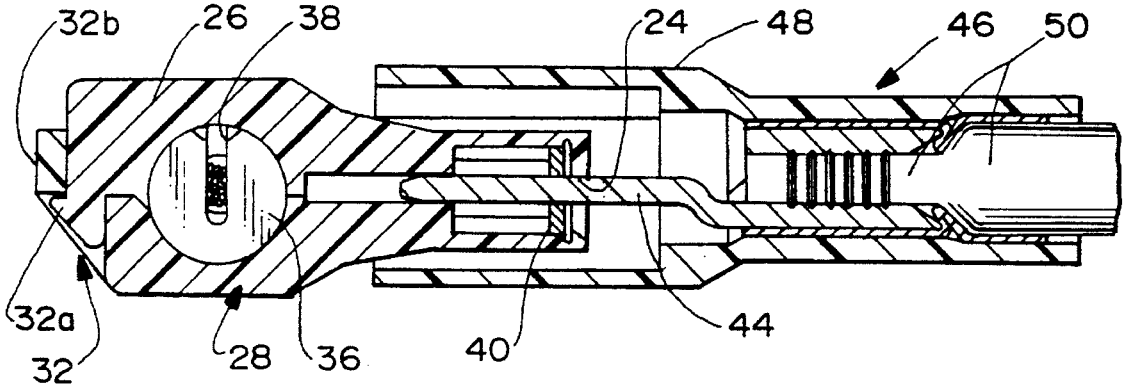
FIG. 3 is a vertical section taken generally along line 3—3 of FIG. 2.

Referring to FIGS. 2 and 3 in conjunction with FIG. 1, connector 10 is shown to include a stamped and formed sheet metal terminal, generally designated 34 in FIG. 2, which includes a pair of generally parallel, planar sections 36 having insulation piercing or displacing slots 38 for terminating insulated electrical wire 12. More particularly, as is known in the art, slots 38 are defined by cutting edges adapted to cut through insulation 14 of wire 12 to establish a direct electrical engagement with conductive core 16 of the wire. This electrical connection is shown best in FIG. 3.

Planar portions 36 of terminal 34 are joined by a U-shaped portion 40 (FIG. 2) which has a slot 42 for receiving a blade contact 44 of a complementary mating connector 46. The mating connector includes a housing 48 defining a receptacle into which plug portion 20 (FIG. 1) of connector 10 is inserted. When the plug portion is inserted into housing 48 of mating connector 46, blade contact 44 moves through slot 24 (FIG. 1) for engagement with U-shaped portion 40 of terminal 34. Blade contact 44 has crimping sections 50 for crimping onto another insulated electrical wire 51 as is known in the art.

FIG. 3 shows latch means 32 between housing halves 26 and 28. Specifically, the latch means include a latch hook **32*a* on housing half 26 which snaps behind a latch bar 32*b* of housing half 28 when the housing halves are in their closed condition as seen in FIGS. 1–3**.

Figure 4:
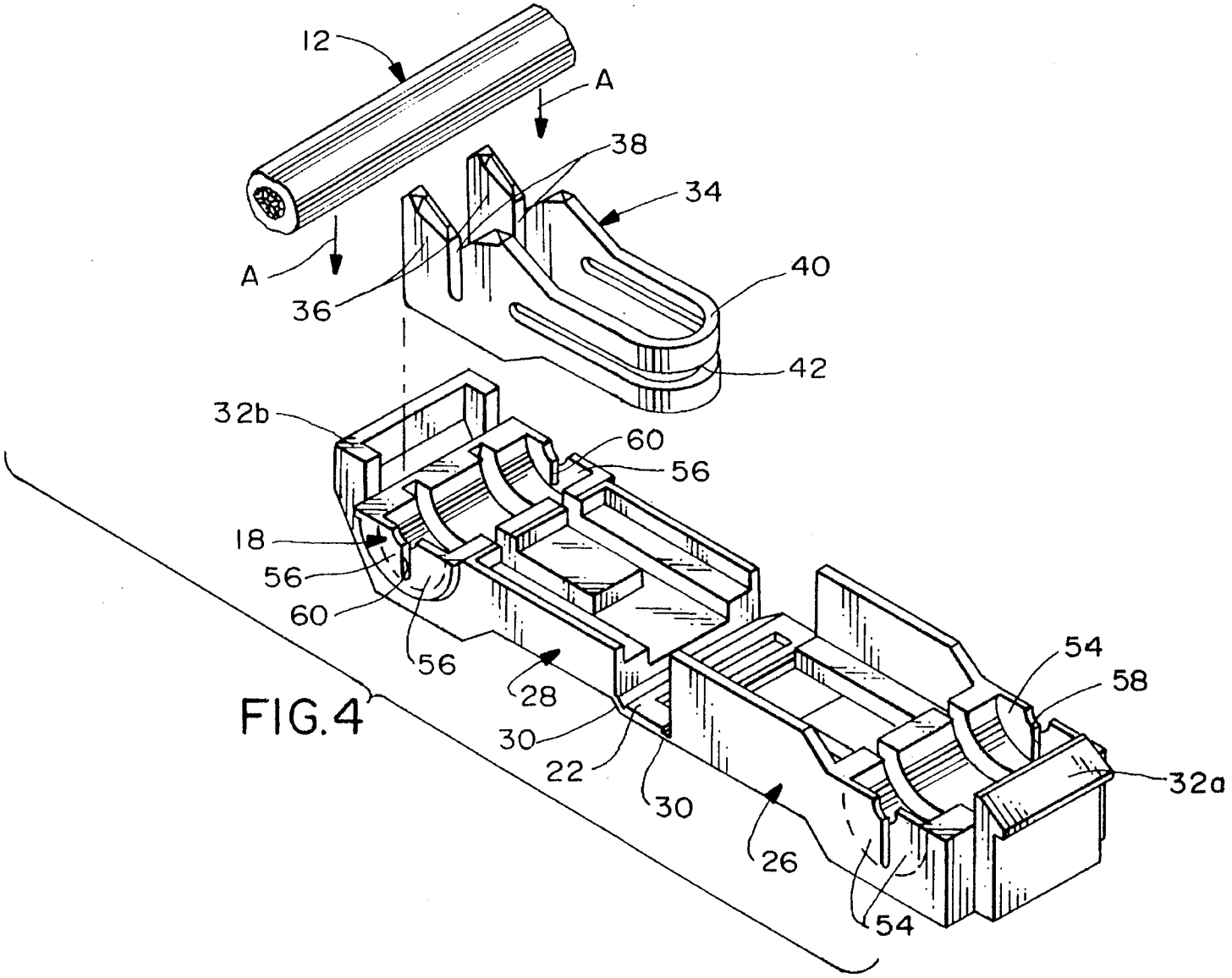
FIG. 4 is a perspective view of the connector assembly in open condition.
Figure 5:
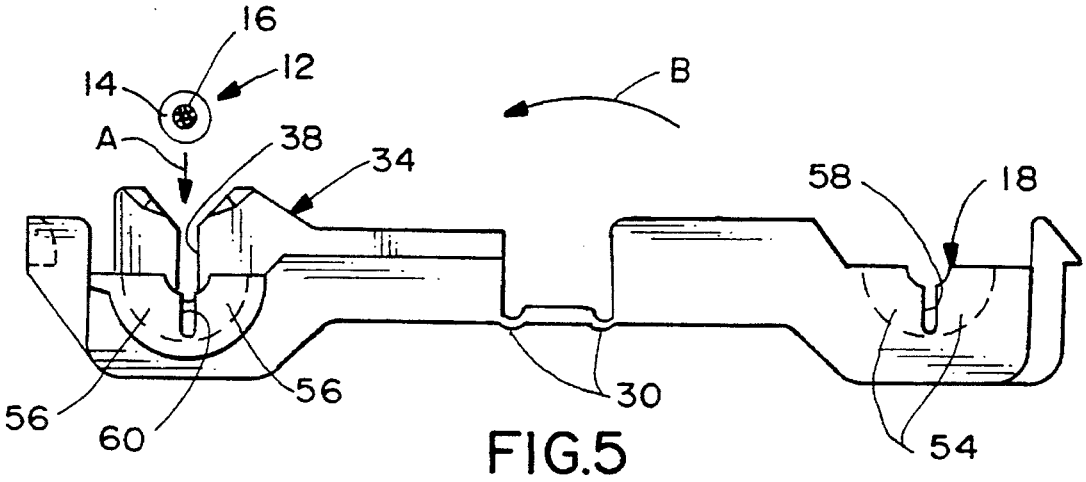
FIG. 5 is a side elevational view of the connector assembly in open condition with a terminal mounted therein and a wire prior to termination thereof.
Figure 6:
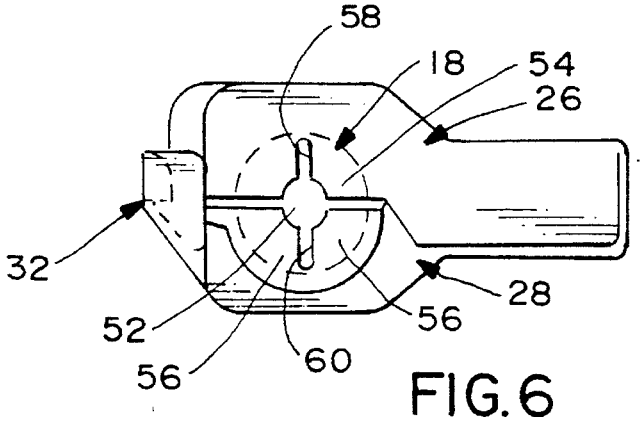
FIG. 6 is a side elevational view of the connector assembly in closed condition without a terminal or wire therein.

Referring to FIGS. 4–6, housing halves 26 and 28 are shown in their relative open condition in FIGS. 4 and 5 and in their relative closed, latched condition in FIG. 6. In particular, insulated electrical wire 12 (FIG. 5) may be forced downwardly in the direction of arrow "A" into insulation displacement slots 38 of terminal 34 by pivoting housing half 26 about integral hinge 30 in the direction of arrow "B" i.e. moving the housing halves from the open condition shown in FIGS. 4 and 5 to the closed condition shown in FIG. 6. Alternatively, the wire may be terminated to the terminal, i.e. forced downwardly into insulation displacement slots 38, prior to pivoting housing half 26 about the hinge means. Nevertheless, in this closed condition, an opening 52 through which the wire passes is "created" (FIG. 6), and strain relief means 18, positioned thereabout, are effective for gripping the insulated wire substantially entirely around the circumference thereof. That is to say, the strain relief means are operatively associated between the housing halves.

Figure 7:
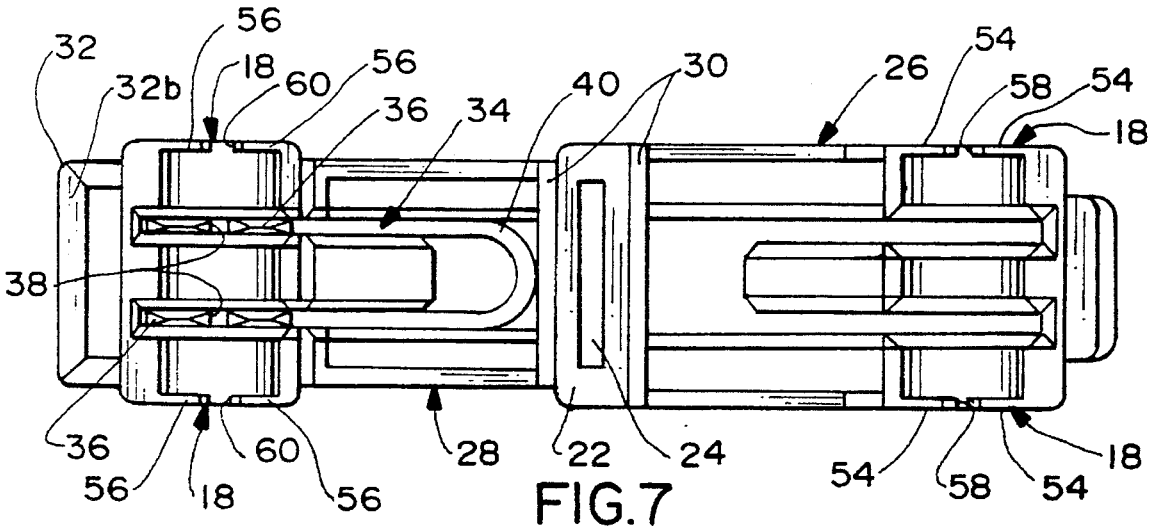
FIG. 7 is a top plan view of the connector assembly in open condition.

More particularly, referring to FIG. 7 in conjunction with FIGS. 1–3, there is a strain relief means 18 on both sides of the electrical connection area of terminal 34, located within the opening 52 generally where the wire exits the housing provided by housing halves 26 and 28. In other words, the strain relief means are located on the housing at a position longitudinally spaced along the wire from insulation displacement slots 38 of planar portions 36 of the terminal. More particularly, each strain relief means 18 on each side of the terminal includes a pair of flexible portions 54 on housing half 26 which oppose a pair of flexible portions 56 on housing half 28. The flexible portions 54 are separated by a slot 58, and flexible portions 56 are separated by a slot 60, to enhance the flexibility of the portions. As seen in FIG. 7, the flexible portions 54 and 56 are provided by relatively thin portions or membranes of the integrally molded plastic housing halves. Therefore, the thin portions can flex or bend as shown best in FIG. 1 to grip electrical wire 12 when the housing halves are in their closed, latched condition. In essence, flexible portions 54 and 56 form quadrants as seen best in FIG. 6, which completely surround and grip the insulated electrical wire to provide a strain relief on the wire where it exits both sides of the connector, thereby preventing bending or deforming of conductor core 16 of the wire at the contact or connection area within insulation-piercing slots 38 of planar portions 36 of terminal 34. Furthermore, the opening 52,. if formed to accommodate the smallest possible insulation diameter of an insulated electrical wire used in the connector assembly, can accommodate a large range of wire diameters without changing the mold or design of the housing. Thus, the flexibility provided by flexible portions 54 and 56 along with slots 58 and 60 allows the connector assembly housing to accept different wire gauge and insulation diameters without adversely affecting the performance of the strain relief 18.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector assembly for terminating an insulated electrical wire having an inner conductor surrounded by insulation, the connector assembly including:

housing means having a wire-receiving opening therein for receiving the insulated electrical wire;

a terminal mounted in the housing means and having an insulation displacement slot adapted to displace the insulation of the wire and electrically engage the inner conductor to create an electrical connection therebetween;

wherein the improvement comprises:

integrally molded strain relief means located adjacent the connection within the wire-receiving opening of the housing means for surrounding and gripping the insulated wire substantially entirely thereabout, wherein the wire-receiving opening extends entirely through the housing means and said integrally molded strain relief means are positioned on both sides of the terminal within the opening adjacent the electrical connection to provide support to the electrical insulated wire in two locations longitudinally spaced along the wire on opposite sides of the terminal, whereby the strain relief means provide support to the insulated electrical wire and strain relieves the inner conductor.

2. In an electrical connector assembly as set forth in claim 1, wherein said housing means is defined by a pair of dielectric housing halves which are relatively movable between an open condition, for insertion of the insulated wire thereinto, and a closed position, wherein the housing halves are positively latched together, and wherein the integrally molded strain relief means are operatively associated between the housing halves and support the insulated electrical wire when the housing halves are in their closed position.

3. In an electrical connector assembly as set forth in claim 2, wherein said housing halves are molded of plastic material, and including integrally molded hinge means between the housing halves to facilitate said relative movement therebetween.

4. In an electrical connector assembly as set forth in claim 2, wherein said strain relief means comprise two complementary flexible portions located on each of the housing halves to yield a total of four areas of support around the insulated electrical wire.

5. In an electrical connector assembly as set forth in claim 4, wherein said two complementary flexible portions are defined by a relatively thin membrane in the shape of a semi-circle having a vertical slot extending therethrough, whereby the flexibility of the flexible portions allows accommodation of and effective strain relief to a wide range of insulated electrical wire diameters.

6. In an electrical connector assembly for terminating an insulated electrical wire having an inner conductor surrounded by insulation, said connector assembly including:

a housing having an opening into which the insulated electrical wire is insertable, a terminal mounted in the housing and having an insulation displacement slot within said opening adapted to displace the insulation of the wire to electrically engage the inner conductor of the wire, wherein the improvement comprises:

flexible strain relief portions of the housing adapted to substantially entirely surround and grip the insulated wire at a location longitudinally spaced along the insulated wire from said insulation displacement slot of the terminal, wherein the opening extends entirely through the housing and the flexible strain relief portions are positioned within the opening on both sides of the terminal to provide support to the electrical insulated wire in two locations longitudinally spaced along the wire on opposite sides of the terminal.

7. In an electrical connector assembly as set forth in claim 6, wherein said housing is molded of plastic material amid said flexible strain relief portions comprises integrally molded portions thereof.

8. In an electrical connector assembly as set forth in claim 7, wherein said housing includes two parts connected by way of an integrally molded hinge, with said integrally molded flexible strain relief portions being on each of the two parts.

9. In an electrical connector assembly as set forth in claim 8, wherein two said flexible strain relief portions are provided on each part of the housing to define four gripping areas about the circumference of the insulated electrical wire, and wherein the flexible strain relief portions can effectively provide support to a range of insulated electrical wire diameters.

* * * * *